US005355202A

United States Patent [19]

Moriya

[11] Patent Number: 5,355,202

[45] Date of Patent: Oct. 11, 1994

[54] METHOD USING MAGNETIC MEMBER TO RETAIN MAGNETIC CARRIER OF DEVELOPER ON A DRUM IN ELECTROPHOTOGRAPHY

[75] Inventor: Yuichi Moriya, Shizuoka, Japan

[73] Assignee: Tomoegawa Paper Co., Ltd., Tokyo, Japan

[21] Appl. No.: 21,046

[22] Filed: Feb. 23, 1993

[30] Foreign Application Priority Data

Feb. 24, 1992 [JP] Japan ..... 4-072160

[51] Int. Cl.[5] ..... G03G 9/08; G03G 15/16

[52] U.S. Cl. ..... 355/271; 430/126

[58] Field of Search ..... 355/273, 274, 305, 306; 430/126, 106.6

[56] References Cited

U.S. PATENT DOCUMENTS 4,640,880 2/1987 Kawanishi et al. ..... 430/106.6

FOREIGN PATENT DOCUMENTS 58-137867 8/1983 Japan ..... 355/274

58-221853 12/1983 Japan ..... 355/274

*Primary Examiner*—Joan H. Pendegrass

*Attorney, Agent, or Firm*—Wenderoth, Lind & Ponack

[57] ABSTRACT

A transfer method for electrophotography uses a two-component developer including a magnetic carrier and a magnetic toner. The toner is transferred to a recording sheet while holding the magnetic carrier on a surface of a developer-holding body with a magnetic member which is capable of magnetic adsorption. The magnetic member is disposed in an interior of, or on an inner surface of, the developer-holding body, at a location corresponding to a location at an outer surface of the developer-holding body past which the recording sheet is fed. Due to the magnetic member, the magnetic carrier is not at all transferred to the recording sheet, and an excellent image can be obtained.

3 Claims, 2 Drawing Sheets

METHOD USING MAGNETIC MEMBER TO RETAIN MAGNETIC CARRIER OF DEVELOPER ON A DRUM IN ELECTROPHOTOGRAPHY

FIELD OF THE INVENTION

The present invention relates to a method of transferring a toner of a two-component developer for electrophotography to a recording sheet. More specifically, it relates to a transfer method for electrophotography using a two-component developer comprising a magnetic carrier and a magnetic toner or a two-component developer comprising a magnetic carrier and nonmagnetic toner, in which the transfer of the magnetic carrier to a recording sheet is prevented.

PRIOR ART

The developer for electrophotography is generally classified into a one-component developer and a two-component developer. Further, the two-component developer is grouped into a combination of a magnetic carrier with a nonmagnetic toner and a combination of a magnetic carrier with a magnetic toner. In a development method using the two-component developer, the decreasing of the sizes of the toner and the carrier is under way for achieving high-equal quality images.

Conventional electrophotography uses an apparatus which is outlined in FIG. 3, in which numeral 1 indicates a photoconductive drum, and a charger 2, an exposure device 3, a developing device 4, a transfer corona charger 5 (transfer member), a separating charger 6 and a fixing device 7 are arranged around the photoconductive drum 1. While the photoconductive drum 1 is rotated in a direction indicated by arrows, the surface of the photoconductive drum 1 is uniformly charged by means of the charger 2, and then selectively exposed by means of the exposure device 3 to form an electrostatic latent image. The developing device 4 provides the electrostatic latent image with a toner to form a developed image, and a recording sheet 10 is placed on the photoconductive drum surface on which the developed image is retained. The transfer corona charger 5 charges the recording sheet 10 with a polarity opposite to the polarity of the toner to transfer the toner to the recording sheet. Then, the separating charger 6 removes the charge of the recording sheet, and the recording sheet is separated from the surface of the photoconductive drum 1. Then, the fixing device 7 fixes the toner on the recording sheet to form an image. Numeral 8 indicates a developer cleaning portion, and numeral 9 indicates a support for an original image. FIG. 3 also illustrates a series of step of an operation from paper feed-in through paper delivery to paper feed-out.

The developing device 4 is formed of a developing sleeve within which a magnet is placed, the magnet being capable of rotating in the same direction as, or in the opposite direction to, the direction in which the photoconductive drum or a dielectric is rotated, a developer-mixing vessel capable of stirring and mixing the developer and a doctor blade capable of controlling the amount of the developer on the developing sleeve. The developing sleeve is a member which is capable of carrying the developer to a developing portion (positioned between the developing sleeve and the photoconductive or dielectric drum, where the developer is transferred to the photoconductive or dielectric drum). As the developing sleeve, an aluminum sleeve is generally used. The developing sleeve is often charged with bias voltage for preventing fogging.

In the above development method using an electrophotographic developer, the carrier adheres to the developing sleeve mainly under a magnetic binding force, and it adheres to the photoconductive drum mainly under an electrostatic force caused by electrostatic charge. The magnetic binding force is in proportion to the cube of the particle diameter of the carrier, while the electrostatic force is in proportion to the square thereof. Therefore, as the particle diameter of the carrier decreases, the influence of the electrostatic force increases. As a result, the carrier easily adheres to the photoconductive drum.

The developer is generally transferred by an electrostatic transfer method, and practically available are a corona transfer method and an electrostatic roller transfer method.

In the corona transfer method, a recording sheet is placed on an image of a toner on the photoconductive drum, and the reverse surface of the recording sheet (a surface which is not in contact with the photoconductive drum surface) is provided with a charge having a polarity opposite to that of the toner, whereby the image of the toner is transferred to the recording sheet. In the electrostatic roller transfer method, a toner layer on a photoconductive drum is transferred to a recording sheet by charging a recording sheet with a voltage through an electrically conductive roller formed of an electrically conductive rubber or a dielectric roller prepared by forming a dielectric layer on an electrically conductive rubber.

In the corona transfer method, due to a friction between the photoconductive drum and the recording sheet, a carrier is sometimes rubbed into inter-fiber gaps of the recording sheet when the image of a toner is transferred. The electrostatic roller transfer method has been attracting attention, since it hardly generates ozone harmful to a human body. However, this method is more liable to cause rubbing of a carrier into inter-fiber gaps of a recording sheet than the corona transfer method.

When a carrier adheres to the photoconductive drum as well as a toner, the carrier is also transferred to a recording sheet to cause a fouling of an image, and white spots occur due to a toner shortage corresponding to the amount of the transferred carrier.

SUMMARY OF THE INVENTION

It is an object of the present invention to provide a transfer method for electrophotography using a two-component developer comprising a magnetic carrier and a magnetic toner or a two-component developer comprising a magnetic carrier and nonmagnetic toner, in which the transfer of the magnetic carrier to a recording sheet is prevented.

According to the present invention, there is provided a transfer method for electrophotography using a two-component developer comprising a magnetic carrier and a toner, which comprises transferring the toner to a recording sheet with holding the magnetic carrier on a surface of a developer-holding body (generally, a photoconductive or dielectric drum) by means of a magnetic member which is capable of magnetic adsorption and placed in an interior of, or on an inner surface of, the developer-holding body corresponding to an outer surface of the developer-holding body on which the recording sheet is fed through.

DETAILED DESCRIPTION OF THE INVENTION

Figure 1:
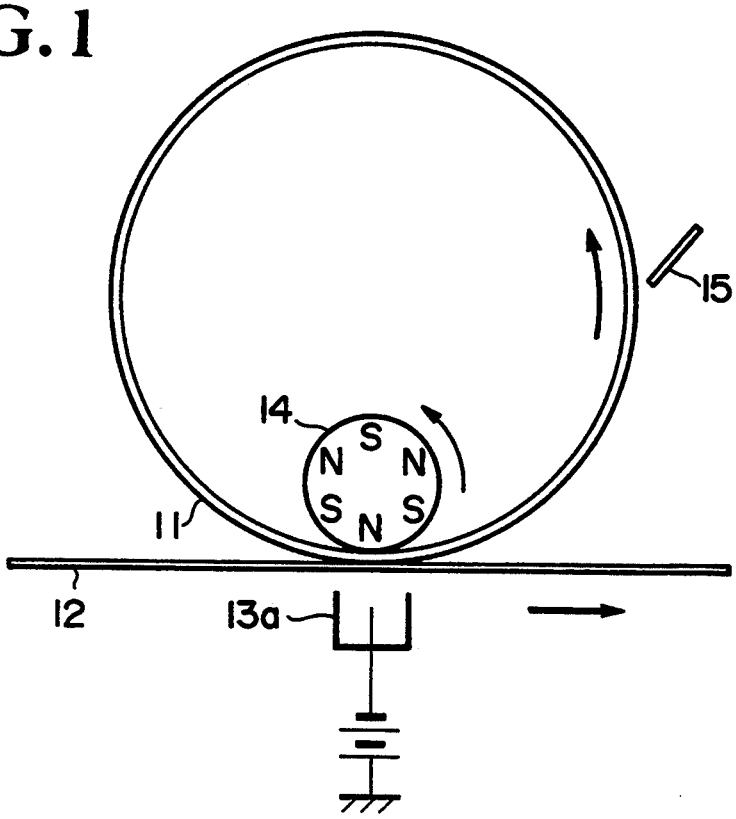
FIG. 1 is a schematic illustrating the transfer method of the present invention.

In the present invention, a Carlson method or an ion flow method is generally used for electrophotography. In the Carlson method, the surface of the developer-holding body (i.e., a photoconductive drum) having photoconductivity is uniformly charged and exposed correspondingly to the shape of an image to form a latent image on the surface of the photoconductive drum, the latent image is developed with a coloring powder (toner) to form a developed image, and the developed image is transferred to a recording sheet and fixed thereon. This photoconductive drum is formed of amorphous selenium, zinc oxide, amorphous silicon or an organic photoconductive material (OPC).

In the ion flow method, a dielectric drum (i.e., a developer-holding body) is used in place of the above photoconductive drum. A latent image is formed on the dielectric drum by irradiating the dielectric drum with a dot-like ion flow having a shape corresponding to an image signal through an ion head. The dielectric drum is formed, for example, of hard alumite. The latent image is developed, and a developed image is transferred and fixed, in the same manner as in the above Carlson method.

The developer used in the present invention comprises a toner having an average particle diameter of 5 to 20 μm and a magnetic carrier (particles) having an average particle diameter of 20 to 150 μm. The carrier is formed of an iron powder, ferrite or magnetite, and it may be coated with silicone or a styrene-acrylic resin. The carrier is used for frictionally charging the toner and carrying the toner to a developing portion.

In the present invention, a magnetic member having magnetic adsorption capability is placed, in an interior of, or on an inner surface of, the photoconductive or dielectric drum to prevent the transfer of the carrier adhering to the drum to a recording sheet.

That is, the carrier adheres to the drum mainly under electrostatic force, while the transfer of the carrier particles to a recording sheet can be prevented by exerting a magnetic binding force on the carrier particles.

The transfer method of the present invention is applied to a developing method using a two-component developer comprising a combination of a magnetic toner with a magnetic carrier or a combination of a nonmagnetic toner and a magnetic carrier. In the combination of a magnetic toner with a magnetic carrier, for example, the saturation magnetization of the magnetic toner is about $\frac{1}{3}$ of the saturation magnetization of the magnetic carrier, and the particle diameter of the magnetic toner is about 1/5 of the particle diameter of the magnetic carrier. As a result, the magnetic binding force of the magnetic member toward the magnetic toner is much smaller than the magnetic binding force of the magnetic member toward the magnetic carrier. Therefore, the magnetic carrier can be easily retained on the photoconductive or dielectric drum without preventing the transfer of the magnetic toner to a recording sheet by properly selecting a magnetic force of the magnetic member and/or a position where the magnetic member is to be placed.

The material forming the magnetic member used in the present invention is preferably selected from barium ferrite, other ferrite-containing magnet and permanent magnets such as, an Alnico (Al-Ni-Co) magnet and a rare earth cobalt magnet.

The magnetic member used in the present invention is placed in an interior of, or on an inner surface of, the developer-holding body (photoconductive or dielectric drum), and that part of the inner surface where the magnetic member is positioned corresponds to an outer surface of the developer-holding body where the recording sheet is fed through. The magnetic member may have a cross section of a rectangle, square or any other form, and may be fixed. The magnetic member may also be of a magnet roll, which rotates at the same peripheral speed as that at which a recording sheet travels and in the same direction as that in which the recording sheet travels. In this case, preferably, the magnet roll is allowed to rotate nearly at the same peripheral speed as that at which a developer-holding body rotates with the axis of the magnet roll as a center while the magnetic roll is in contact with the inner surface of the developer-holding body. Further, it is preferred to structure the magnet roll such that it rotates as described above, since this structure is simple. Furthermore, the rotation of the magnet roll as described above prevents mutilation of a toner image which might be caused when a magnetic carrier held on the developer-holding body is retained thereon due to the magnetic force of the magnetic member without being carried away to a cleaning portion. A developer cleaning unit is placed in a position where the carrier is away from the magnetic binding force of the magnetic member, to thereby remove the developer from the surface of the developer-holding body (photoconductive or dielectric drum).

According to the transfer method of the present invention, the carrier adhering to developer-holding body is not at all transferred to a recording sheet, or an excellent transfer image can be obtained.

EXAMPLES

Figure 2:
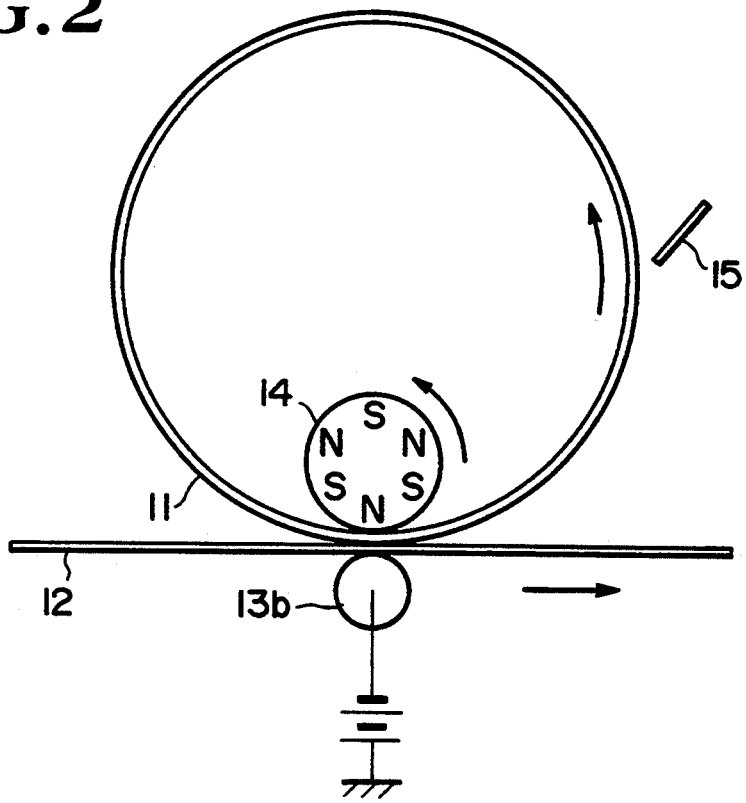
FIG. 2 is a schematic illustrating another embodiment of the transfer method of the present invention.
Figure 3:
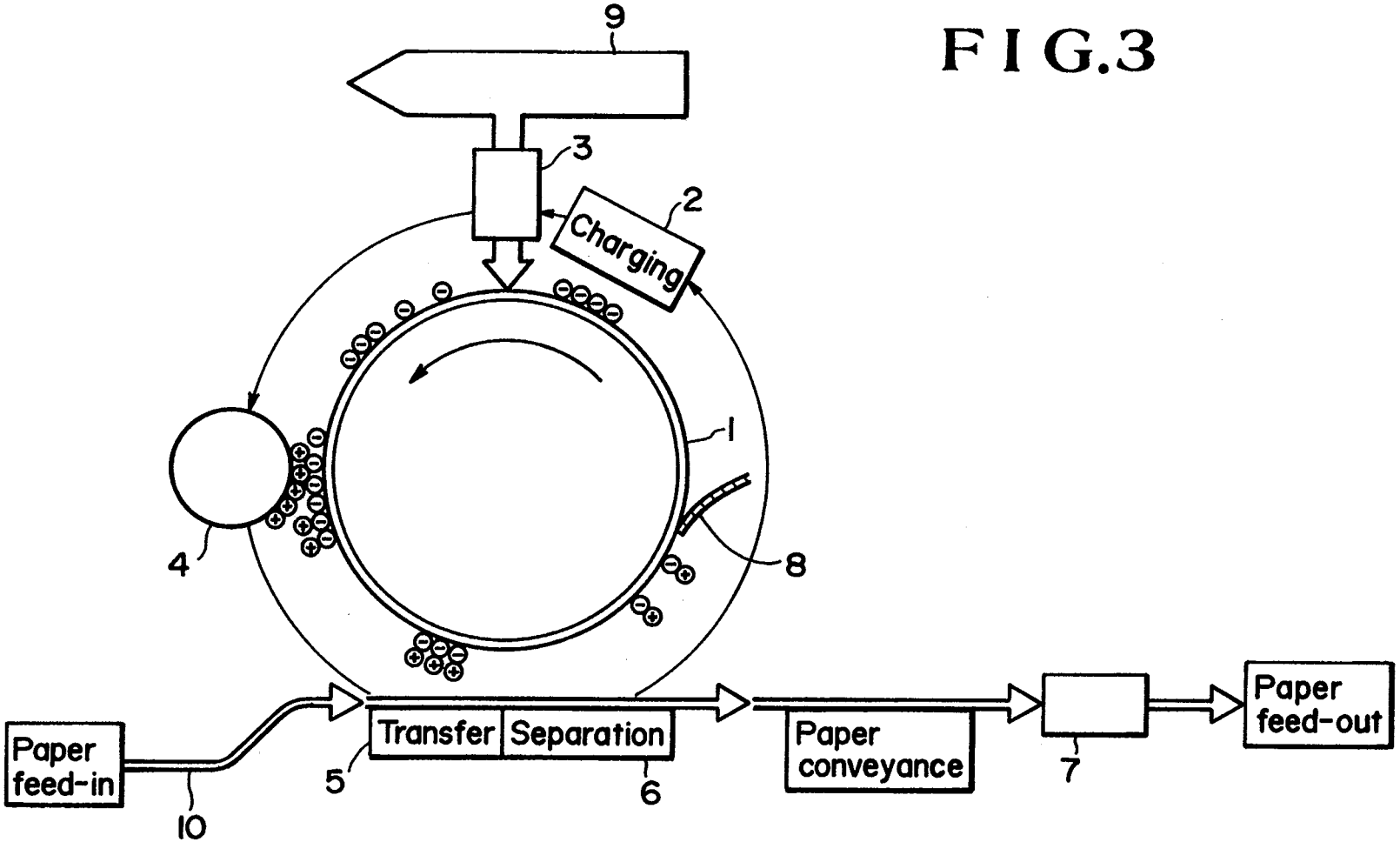
FIG. 3 is a schematic diagram of one embodiment of a conventional electrophotographic recording apparatus.

A developer comprising a silicon ferrite carrier having an average particle diameter of 60 μm and a positively chargeable nonmagnetic toner having an average particle diameter of 8 μm was subjected to transfer tests as described in Examples 1 and 2 and Comparative Examples 1 and 2. FIGS. 1 and 2 show essential portions of the transfer method according to the present invention.

EXAMPLE 1

A transfer test was carried out according to a method shown in FIG. 1, in which numeral 11 indicates a negatively chargeable OPC photoconductive drum obtained by coating a specularly treated aluminum cylinder having a diameter of 60 mm with a CG material prepared by dispersing an azo pigment in a butyral resin and a CT material prepared by dispersing a hydrazone compound in polycarbonate, numeral 12 indicates a recording sheet, 13*a* indicates a corona charger charged at DC 2 KV, numeral 14 indicates a magnet roll having a diameter of 25 mm, and numeral 15 indicates a cleaning blade (developer cleaning portion) made of urethane. The peripheral speed of the photoconductive drum 11 and the peripheral speed of the magnet roll were set at 120 ram/sec. This transfer test showed that the silicone ferrite carrier adhered to the photoconductive drum 11 before the transferring, but that no carrier adhered to the recording sheet 12 after the transferring.

EXAMPLE 2

A transfer test was carried out according to a method shown in FIG. 2, in which numeral **13*b* indicates an electrically conductive rubber roller having a volume resistivity of about $10^5\Omega$.cm, which was a substitute for the corona charger 13*a* in Example 1 and charged at DC 1.5 KV. This transfer test showed that the silicone ferrite carrier adhered to the photoconductive drum 11 before the transferring, but that no carrier adhered to the recording sheet 12** after the transferring.

Comparative Example 1

The transfer test was carried out in the same manner as in Example 1 except that the magnet roll 14 was omitted from the transfer apparatus used in Example 1. After the transferring, the carrier adhered to the recording sheet 12.

Comparative Example 2

The transfer test was carried out in the same manner as in Example 2 except that the magnet roll 14 was omitted from the transfer apparatus used in Example 2. After the transferring, the carrier adhered to the recording sheet 12.

Further, when the transfer test was carried out by using a dielectric drum formed of hard alumite in place of the above photoconductive drum, the same results as those in Examples 1 and 2 were obtained.

What is claimed is:

1. A transfer method for electrophotography comprising: providing a two-component developer comprising a magnetic carrier and a magnetic toner having a lower magnetic saturation than the magnetic carrier; transferring the magnetic toner to a recording sheet while holding the magnetic carrier on a surface of a developer-holding body with a magnetic member which is capable of magnetic adsorption and is disposed in an interior of, or on an inner surface of, the developer-holding body at a location corresponding to a location at an outer surface of the developer-holding body past which the recording sheet is fed.

2. A transfer method according to claim 1, wherein the magnetic member is a magnetic roll, and further comprising the step of rotating the magnetic roll nearly at the same peripheral speed as that at which the developer-holding body rotates with the magnetic roll being in contact with an inner surface of the developer-holding body.

3. A transfer method according to claim 1, and further comprising removing the magnetic carrier from the surface of the developer-holding body with a developer cleaning member contacting the magnetic carrier at a location where the magnetic carrier is beyond a magnetic binding force of the magnetic member.

* * * * *